US009242334B2

(12) United States Patent
Chen

(10) Patent No.: US 9,242,334 B2
(45) Date of Patent: Jan. 26, 2016

(54) TRANSFORM MECHANISM OF A FINISHING WHEEL FOR AN ABRASIVE BELT POLISHING FINISHER

(71) Applicant: Qiyue Chen, Taizhou (CN)

(72) Inventor: Qiyue Chen, Taizhou (CN)

(73) Assignee: Taizhou Federal Robot Technology Co., Ltd, Taizhou (CN)

( * ) Notice: Subject to any disclaimer, the term of this patent is extended or adjusted under 35 U.S.C. 154(b) by 0 days.

(21) Appl. No.: 14/450,253

(22) Filed: Aug. 3, 2014

(65) Prior Publication Data

US 2015/0099434 A1 Apr. 9, 2015

(30) Foreign Application Priority Data

Oct. 9, 2013 (CN) ..... 2013 1 0467984

(51) Int. Cl.

| | |
|---|---|
| ***B24B 21/14*** | (2006.01) |
| ***B24B 21/18*** | (2006.01) |
| ***B24B 21/16*** | (2006.01) |
| ***B24B 41/02*** | (2006.01) |
| ***B24B 21/12*** | (2006.01) |
| ***B24B 21/20*** | (2006.01) |

(52) U.S. Cl.

CPC ..... *B24B 21/14* (2013.01); *B24B 21/12* (2013.01); *B24B 21/16* (2013.01); *B24B 21/18* (2013.01); *B24B 21/20* (2013.01); *B24B 41/02* (2013.01)

(58) Field of Classification Search

CPC ..... B24B 21/14; B24B 21/18; B24B 21/025; B24B 21/02; B24B 5/38

See application file for complete search history.

(56) References Cited

U.S. PATENT DOCUMENTS

| | | | | |
|---|---|---|---|---|
| 4,945,683 A * | 8/1990 | Phillips | ..... | 451/307 |
| 5,791,969 A * | 8/1998 | Lund | ..... | 451/5 |
| 6,544,108 B2 * | 4/2003 | McCoy | ..... | 451/49 |

FOREIGN PATENT DOCUMENTS

| | | | | |
|---|---|---|---|---|
| CN | 201645305 U | 11/2010 | | |
| CN | 102303275 A | 1/2012 | | |
| CN | 202540094 U | 11/2012 | | |
| DE | 4000251 A1 * | 2/1991 | ..... | B24B 5/38 |

* cited by examiner

*Primary Examiner* — Dung Van Nguyen

(74) *Attorney, Agent, or Firm* — Minder Law Group; Willy H. Wong

(57) ABSTRACT

The invention discloses a transform mechanism of a finishing wheel for an abrasive belt polishing finisher in the field of mechanical technology. The invention is disposed on the inner side of the abrasive belt of the finisher, comprising several slide rails disposed on the side of the frame of the finisher and sliders on the slide rails. A finishing wheel is fixedly connected with each of the sliders. The curved surface of the rim of each of the said finishing wheels has a different curvature. A driving element connected with the slider is provided on the frame of the finisher close to each of the sliders. The finishing wheel corresponding to the driving element, driven by the said driving element, is pressed against the inner side of the abrasive belt. The transform mechanism of the invention could be widely applied and has a high polishing and finishing efficiency.

11 Claims, 3 Drawing Sheets

TRANSFORM MECHANISM OF A FINISHING WHEEL FOR AN ABRASIVE BELT POLISHING FINISHER

BACKGROUND OF THE INVENTION

1. Field of Invention

The present invention pertains to the field of mechanical technology. The invention relates to a finishing wheel for an abrasive belt polishing finisher, and particularly to a transform mechanism of a finishing wheel for an abrasive belt polishing finisher.

2. Related Art

The abrasive belt polishing finisher is one of the polishing finishers, and is an ordinary mechanical processing device for polishing and finishing the surface of the work piece. The abrasive belt polishing finisher has been widely applied in hardware and plumbing industries. The surface of the work piece is polished and finished by contacting the surface of the work piece with the abrasive belt and using the grinding performance of the abrasive particles on the abrasive belt in the abrasive belt polishing finisher. The quality and precision of the surface of the work piece are good upon abrasive belt polishing and finishing.

The existing the abrasive belt polishing finishers generally comprise a frame and a work station provided on the frame. A driving wheel, a driven wheel and a tension wheel are mounted on the frame. An abrasive belt is coupled with the driving wheel, driven wheel and tension wheel. In operation, the abrasive belt is tightened by the tension wheel and moves with rotation of the drive wheel. The work piece to be finished is pressed against the abrasive belt at the work station, and is polished and finished by the moving abrasive belt as such.

The existing abrasive belt polishing finishers could be smoothly used for processing work pieces without any special curved surface. However, with respect to work pieces having a number of complicated curved surfaces, for example, water taps, the desired curved surfaces could not be completely processed by using the conventional plane abrasive belts. The special curved surfaces on the surface of the work piece are conventionally polished and finished by the operators, which is not only labor intensive and time and labor consuming, but also has a very poor polishing and finishing efficiency. Moreover, the polishing and finishing precision of the surface of the work piece is not enough.

SUMMARY OF THE INVENTION

In order to address the problems existing in the prior art, it is an object of the invention to provide a transform mechanism of a finishing wheel for an abrasive belt polishing finisher, in which special curved surfaces of the work piece could be polished and finished by using the transform mechanism and the polishing and finishing efficiency is poor.

The invention provides a transform mechanism of a finishing wheel for an abrasive belt polishing finisher disposed on the inner side of the abrasive belt of the finisher. The transform mechanism comprises several slide rails disposed on the side of the frame of the finisher and sliders on the slide rails. A finishing wheel is fixedly connected with each of the sliders. The curved surface of the rim of each of the said finishing wheels has a different curvature. A driving element connected with the slider is provided on the frame of the finisher close to each of the sliders. The finishing wheel corresponding to the driving element, driven by the said driving element, is pressed against the inner side of the abrasive belt.

The transform mechanism of the finishing wheel for the abrasive belt polishing finisher is mounted on the inner side of the abrasive belt of the polishing finisher and provided with preset program before use. When the abrasive belt of the polishing finisher is in transmission, the work piece is caught by the manipulator tightly to be in contact with the abrasive belt, and the surface of the work piece could be subject to ordinary polishing and finishing treatment. When the work piece has to be processed with special curved surfaces, the finishing wheel with the corresponding curvature has to be selected, and the driving element corresponding to the said finishing wheel will be controlled by preset program to operate. The slider is driven by the driving element to bring the finishing wheel to move forward and press against the inner side of the abrasive belt. The outer side of the abrasive belt has a shape identical to that of the rim of the finishing wheel. As such, the surface of the work piece could be processed with curveted surfaces with a corresponding curvature by polishing and finishing.

In the transform mechanism of the finishing wheel for the abrasive belt polishing finisher, the side of the frame of the finisher is fixedly connected with a mounting plate. Mounting grooves corresponding to the shape of the slide rails are formed on the mounting plate. The slide rails are fixed within the mounting grooves.

In the transform mechanism of the finishing wheel for the abrasive belt polishing finisher, the driving element has an air cylinder and a solenoid valve. Both the air cylinder body and the solenoid valve are fixed on the mounting plate. A plate-like connection part is projected from the side of the slider. The end of the piston rod of the air cylinder is vertically fixedly connected with the plate-like connection part.

When one of the finishing wheels has to be pressed against the inner side of the abrasive belt, the remaining solenoid valves are controlled by program to turn off, and the solenoid valve corresponding to the said finishing wheel is controlled by program to turn on. The solenoid valve is turned on and the air cylinder body is supplied with air from an air source. The piston rod of the air cylinder moves forwards. As the piston rod of the air cylinder is vertically fixedly connected with the plate-like connection part on the side of the positioning block, the positioning block and the finishing wheel on the positioning block could be driven to move forward as the piston rod of the air cylinder moves forward.

In the transform mechanism of the finishing wheel for the abrasive belt polishing finisher, a positioning block is fixedly connected with the slider. The finishing wheel is fixed on the positioning block via a connection rod. The plate-like connection part is located on the side of the positioning block. The positioning blocks and the sliders under the positioning blocks will be driven to move forward along the slide rails when the piston rods of the air cylinders move forward.

In the transform mechanism of the finishing wheel for the abrasive belt polishing finisher, slide plates are fixed on the mounting plate. The front end of the air cylinder body is fixedly connected with the slide plate. A chute is provided on the slide plate. The slider plates are connected with the mounting plate through fasteners passing through the chutes.

The air cylinder bodies are fixed on the slide plates. As the slide plates are connected with the mounting plate through fasteners passing through the chutes, when the fasteners are loosened up, the chutes on the slide plates could move along the fasteners, so that the initial mounting positions of the air cylinder bodies could be adjusted accordingly.

In the transform mechanism of the finishing wheel for the abrasive belt polishing finisher, the driving element has an oil cylinder and a solenoid valve. Both the oil cylinder body and the solenoid valve are fixed on the mounting plate. The plate-like connection part is projected from the side of the positioning block. The end of the piston rod of the oil cylinder is vertically fixedly connected with the plate-like connection part.

The principle of the oil cylinder is the same as that of the air cylinder. When the finishing wheel has to be driven to press against the inner side of the abrasive belt, the solenoid valve corresponding to the said finishing wheel is turned on, and the oil cylinder body is supplied with oil. The piston rod of the oil cylinder is driven by oil pressure to press forward to move forward the positioning block.

In the transform mechanism of the finishing wheel for the abrasive belt polishing finisher, the driving element has a motor and a lead screw. The lead screw is connected with the inner side of the slider. The motor is fixed on the mounting plate. One end of the rotation shaft of the motor is connected with one end of the lead screw. The motor is one of the ordinary driving elements. The rotation shaft of the motor drives the lead screw into rotation. As the lead screw is connected to the inner side of the slider, the rotation of the lead screw will be turned into axial movement of the slider.

In the transform mechanism of the finishing wheel for the abrasive belt polishing finisher, the number of the finishing wheels is 2, 3, or 4.

Compared with the prior art, the surface of the work piece could be processed with curved surfaces with different curvatures by high-quality polishing and finishing treatment by using the transform mechanism of the finishing wheel for the abrasive belt polishing finisher. The transform mechanism could be widely applied. As each of the finishing wheels has its own driving element, the finishing wheels can be more quickly and precisely controlled. Each of the finishing wheels will not influence each other and could be switched more reliably.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The embodiments of the invention will be described below and the technical solutions of the invention will be further illustrated in connection with the accompanying figures. However, the present invention shall not be limited to these embodiments.

First Embodiment

Figure 1:
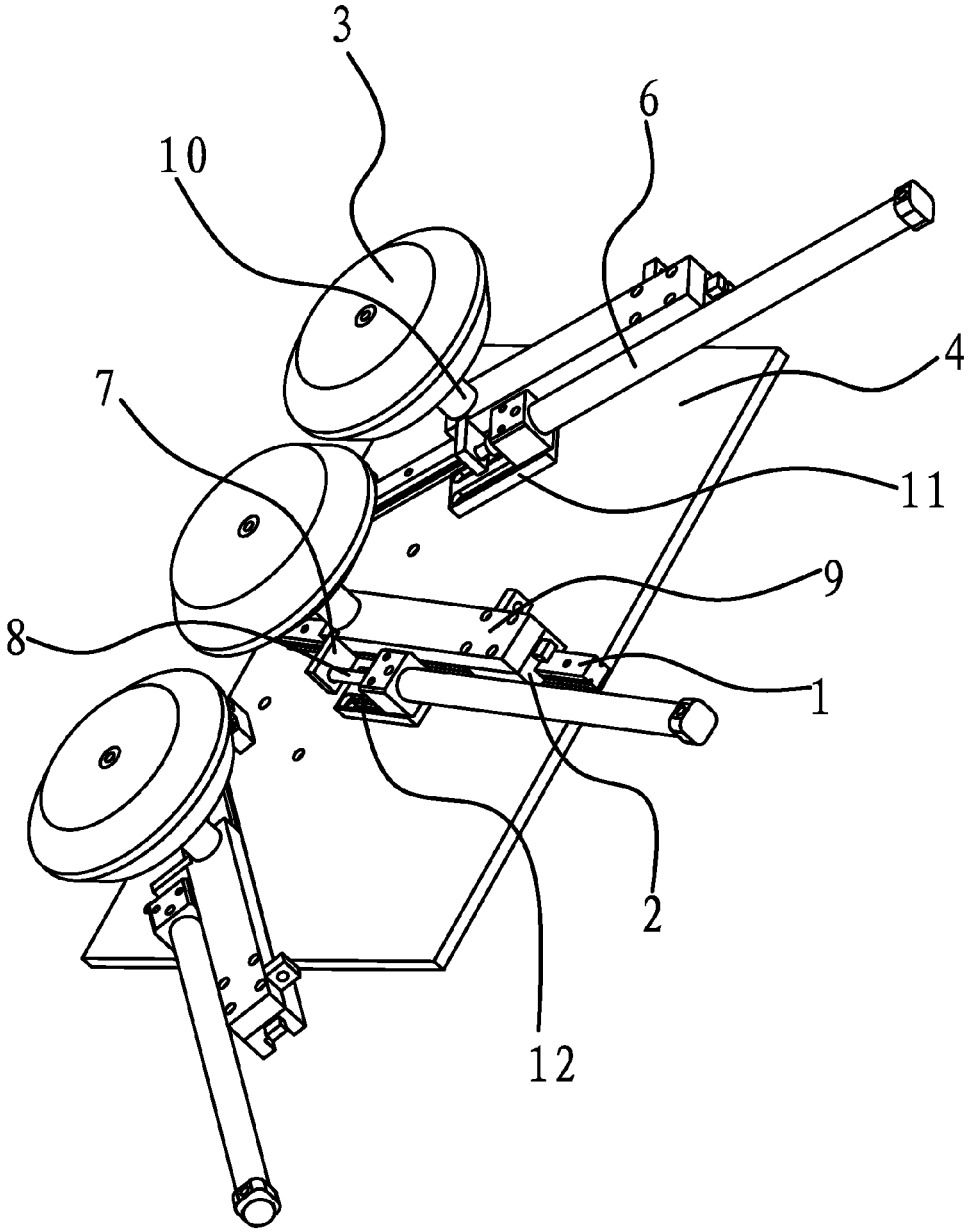
FIG. 1 is a diagram of a transform mechanism of a finishing wheel for an abrasive belt polishing finisher of the invention.
Figure 2:
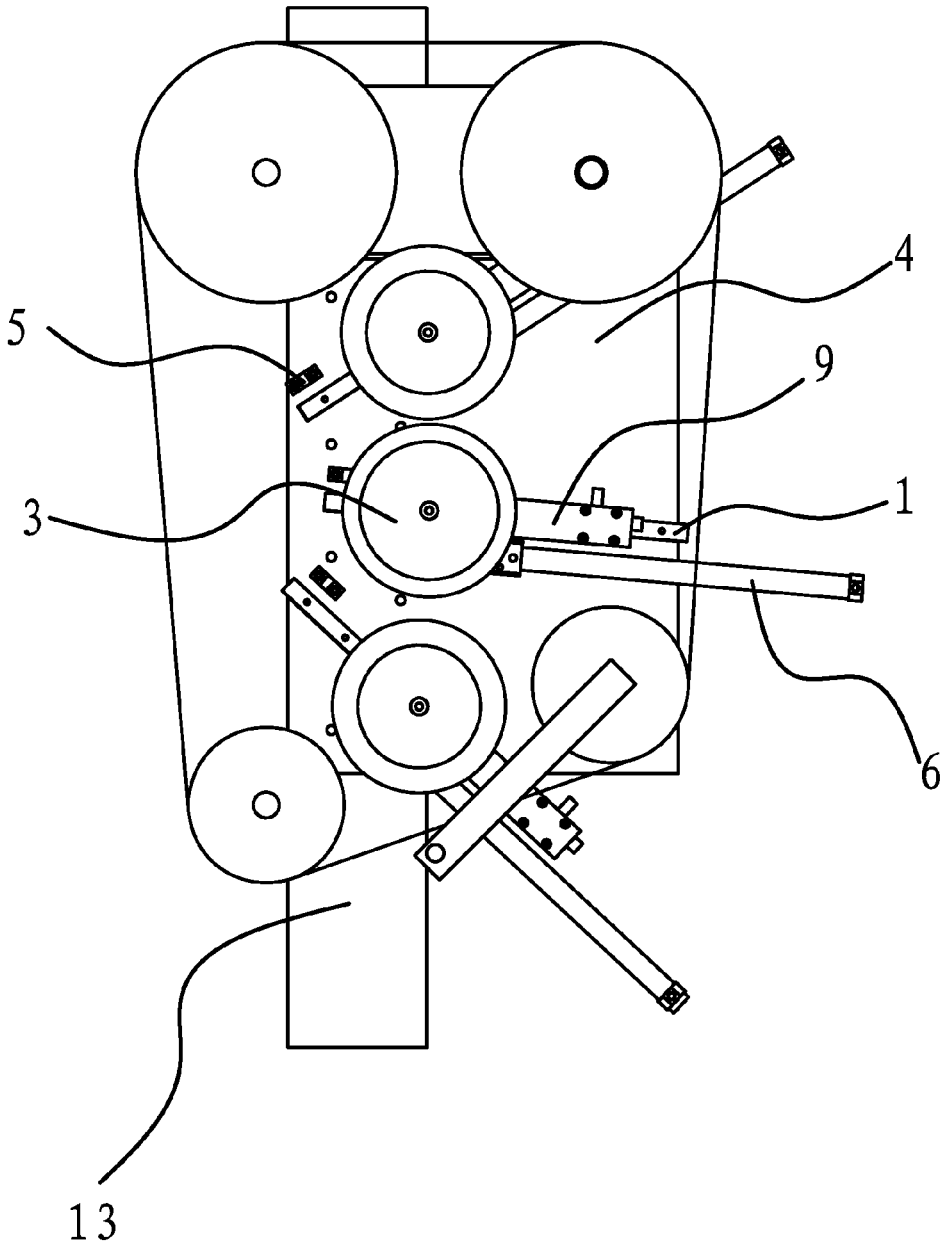
FIG. 2 is a side view of the transform mechanism of the finishing wheel for the abrasive belt polishing finisher of the invention after being applied to the polishing finisher.
Figure 3:
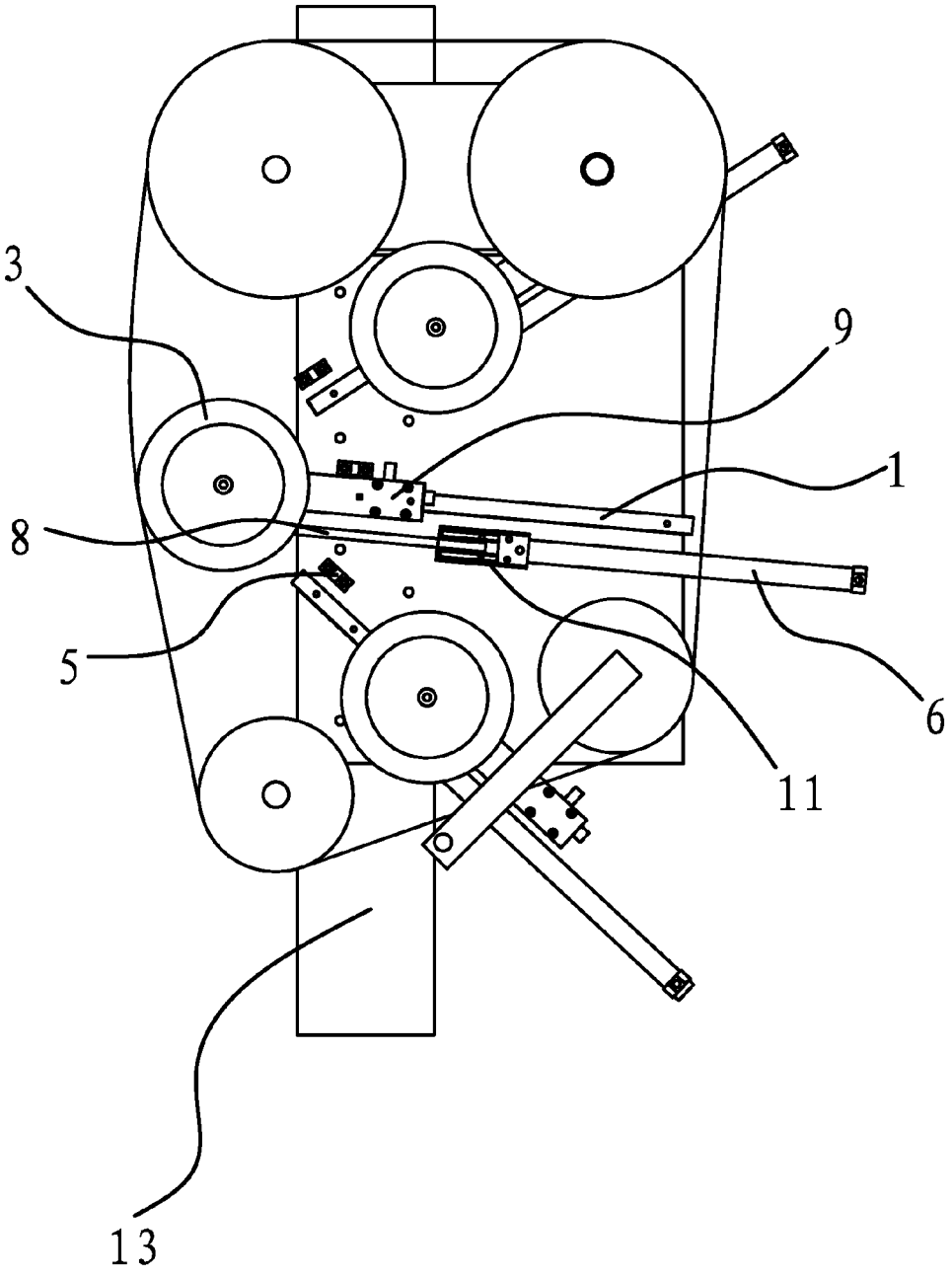
FIG. 3 is a side view of the transform mechanism of the finishing wheel for the abrasive belt polishing finisher of the invention in use.

As shown in FIGS. 1-3, a transform mechanism of a finishing wheel for an abrasive belt polishing finisher is provided on the inner side of the abrasive belt of the finisher. The transform mechanism comprises three slide rails 1 disposed on the side of frame 13 of the finisher and sliders 2 on the slide rails 1. The side of the frame 13 of the finisher is fixedly connected with a mounting plate 4. Mounting grooves having a shape matched with the slide rails 1 are formed on the mounting plate 4. The slide rails 1 are fixed into the mounting grooves.

Each of the sliders 2 on three slide rails 1 is connected with a finishing wheel 3. The curved surfaces on the rim of the three finishing wheels 3 have different curvatures. A driving element connected with the slider 2 is located on the frame 13 of the finisher close to each slider 2. The driving element could be an air cylinder and a solenoid valve 5. The solenoid valves 5 are fixed on the mounting plate 4 to which slide plates 11 are fixed. The front end of the air cylinder body 6 is fixedly connected with the slide plate 11. Chutes 12 are set on the slide plates 11 and the slide plates 11 are connected with the mounting plate 4 through fasteners passing through the chutes. Of course, the fastener could be a bolt or a screw.

A positioning block 9 is fixed on the slider 2. A plate-like connection part 7 is projected from the side of the positioning block 9. The finishing wheel 3 is fixedly connected with the positioning block 9 via the connection rod 10. The end of the piston rod 8 of the air cylinder is vertically fixedly connected with the plate-like connection part 7 on the side of the positioning block 9.

As shown in FIG. 2, before the transform mechanism of the finishing wheel for the abrasive belt polishing finisher is used, the transform mechanism is mounted on the inner side of the abrasive belt of the abrasive belt polishing finisher. In particular, when the transform mechanism is to be mounted, the mounting plate 4 is firstly fixed on the side of the frame 13 of the finisher, the slide rails 1 are then fixed within the mounting grooves on the mounting plate 4, the sliders 2 and positioning blocks 9 fixedly connected with each other are located on the slide rail 1, the air cylinder bodies 6 are fixed on the slide plates 11 on the mounting plate 4, the piston rods 8 of the air cylinders are fixedly connected with the plate-like connection parts 7 on the side of the positioning blocks 9, and eventually each of the finishing wheel 3 is fixed on the corresponding positioning block 9 through the connection rod 10. As the slide plates 11 pass through the fasteners of the chutes 12 on the slide plates 11 and are fixed on the mounting plate 4, when the fasteners are loosened up, the slide plates 11 could move via the chutes 12 along the axial direction of the fasteners, so that the initial positions of the air cylinder bodies 6 could be adjusted accordingly. Of course, a solenoid valve 5 is fixed on the mounting plate 4 before use, and the air cylinder is controlled by turning on and off the solenoid valve 5 through preset program.

When the polishing finisher is turned on, the abrasive belt of the polishing finisher is in transmission, the work piece is caught by the manipulator tightly to be polished and finished, and the surface of the work piece could be only subject to normal polishing and finishing treatment by the abrasive belt.

Referring to FIG. 3, when the surface of the work piece has special curved surfaces to be finished, after the ordinary curved surfaces of the work piece are polished and finished, the finishing wheel 3 corresponding to the curvature of the surface of the work piece to be polished and finished is selected by the preset program, the solenoid valve 5 corresponding to the finishing wheel 3 is controlled to be turned on by program and the remaining two solenoid valves 5 are turned off. The air cylinder body 6 corresponding to the selected finishing wheel 3 is supplied with air. The piston rod 8 of the air cylinder moves forward, to bring the positioning block 9 to move forward along the slide rail 1 through the slider fixedly connected with positioning block 9, so that the finishing wheel 3 fixed on the positioning block 9 could be pressed against the inner side of the abrasive belt. As such, a shape identical to that of the rim of the finishing wheel 3 could be formed on the outer side of the abrasive belt, so that special curved surfaces could be processed on the work piece through the abrasive belt.

After the polishing and finishing treatment is finished, if a finishing wheel with a different curvature is required, the piston rod 8 of the air cylinder corresponding to the current finishing wheel 3 is controlled by program to retract, and another corresponding finishing wheel 3 is selected to repeat the aforesaid process for polishing and finishing.

Second Embodiment

The structure and principle of the transform mechanism of a finishing wheel for an abrasive belt polishing finisher according to this embodiment are substantially the same as those of the first embodiment except that, the driving element in this embodiment is embodied as an oil cylinder and a solenoid valve 5, in which both the oil cylinder body 6 and the solenoid valve 5 are fixed on the mounting plate 4. A plate-like connection part 7 is projected from the side of the positioning block 9. The end of the piston rod 8 of the oil cylinder is vertically fixedly connected with the plate-like connection part 7. The operation of the oil cylinder is the same as that of the air cylinder.

Third Embodiment

The structure and principle of the transform mechanism of a finishing wheel for an abrasive belt polishing finisher according to this embodiment are substantially the same as those of the first embodiment except that, the driving element in this embodiment is embodied as a motor and a lead screw, in which the motor is fixed on the mounting plate 4 and one end of the rotation shaft of the motor is connected with one end of the lead screw. The rotation shaft of the corresponding motor is controlled by program into rotation, and the lead screw is driven into rotation by the rotation shaft of the motor. As the lead screw is connected to the inner side of the slider 2, the rotation of the lead screw could be turned into axial movement of the slider 2, so that the corresponding finishing wheel 3 could move forward and be pressed against the inner side of the abrasive belt.

The embodiments described herein are merely illustrative of the spirit of the invention. It is obvious for those skilled in the art to make various modifications, supplements or alternatives to these embodiments without departing from the spirit of the invention or the scope as defined by the appended claims.

LIST OF REFERENCE NUMERALS

1 Slide Rail
2 Slider
3 Finishing Wheel
4 Mounting Plate
5 Solenoid Valve
6 Cylinder Body
7 Plate-like Connection Part
8 Piston Rod
9 Positioning Block
10 Connection Rod
11 Slider Plate
12 Chute
13 Frame

What is claimed is:

1. A transform mechanism of finishing wheels on an abrasive belt polishing finisher disposed on an inner side of an abrasive belt of the finisher, comprising:

a plurality of slide rails (1) disposed on a side of a frame (13) of the finisher;

a slider (2) on each slide rail (1), at least one finishing wheel (3) fixedly connected to each slider (2);

a curved surface of a rim of each finishing wheel (3), each curved surface having a different curvature;

a driving element connected with each slider (2) provided on the frame (13) of the finisher close to each slider (3), each driving element corresponding to at least one finishing wheel (3), driven by the driving element, is pressed against the inner side of the abrasive belt;

a mounting plate (4) fixedly connected to the side of the frame (13) of the finisher; and mounting grooves corresponding to a shape of the slide rails (1), the mounting grooves are formed on the mounting plate (4), and the slide rails (1) are fixed within the mounting grooves;

wherein the driving element has an air cylinder and a solenoid valve (5), both the air cylinder body (6) and the solenoid valve (5) are fixed on the mounting plate (4), a connection part (7) is projected from a side of the slider (2), and an end of the piston rod (8) of the air cylinder is vertically fixedly connected with the connection part (7).

2. The transform mechanism as claimed in claim 1, characterized in that, a positioning block (9) is fixedly connected with the slider (2), the finishing wheel (3) is fixed on the positioning block (9) via a connection rod (10), and the connection part (7) is located on a side of the positioning block (9).

3. The transform mechanism as claimed in claim 2, characterized in that, slide plates (11) are fixed on the mounting plate (4), a front end of the air cylinder body (6) is fixedly connected with the slide plate (11), a chute (12) is provided on the slide plate (11), and the slider plates (11) are connected with the mounting plate (4) through fasteners passing through the chutes (12).

4. The transform mechanism as claimed in claim 2, characterized in that, the driving element has an oil cylinder and the solenoid valve (5), both the oil cylinder body (6) and the solenoid valve (5) are fixed on the mounting plate (4), the connection part (7) is projected from the side of the positioning block (9), and the end of the piston rod (8) of the oil cylinder is vertically fixedly connected with the connection part (7).

5. The transform mechanism as claimed in claim 2, characterized in that, the driving element has a motor and a lead screw, the lead screw is connected with an inner side of the slider (2), the motor is fixed on the mounting plate (4), and one end of the rotation shaft of the motor is connected with one end of the lead screw.

6. The transform mechanism as claimed in claim 1, characterized in that, slide plates (11) are fixed on the mounting plate (4), a front end of the air cylinder body (6) is fixedly connected with the slide plate (11), a chute (12) is provided on the slide plate (11), and the slider plates (11) are connected with the mounting plate (4) through fasteners passing through the chutes (12).

7. The transform mechanism as claimed in claim 6, characterized in that, the driving element has an oil cylinder and the solenoid valve (5), both the oil cylinder body (6) and the solenoid valve (5) are fixed on the mounting plate (4), the connection part (7) is projected from a side of a positioning block (9), and the end of the piston rod (8) of the oil cylinder is vertically fixedly connected with the connection part (7).

8. The transform mechanism as claimed in claim 7, characterized in that, the number of the finishing wheels (3) is 2, 3, or 4.

9. The transform mechanism as claimed in claim 6, characterized in that, the driving element has a motor and a lead screw, the lead screw is connected with an inner side of the slider (2), the motor is fixed on the mounting plate (4), and one end of the rotation shaft of the motor is connected with one end of the lead screw.

10. The transform mechanism as claimed in claim 1, characterized in that, the driving element has an oil cylinder and the solenoid valve (5), both the oil cylinder body (6) and the solenoid valve (5) are fixed on the mounting plate (4), the connection part (7) is projected from a side of a positioning block (9), and the end of the piston rod (8) of the oil cylinder is vertically fixedly connected with the connection part (7).

11. The transform mechanism as claimed in claim 1, characterized in that, the driving element has a motor and a lead screw, the lead screw is connected with an inner side of the slider (2), the motor is fixed on the mounting plate (4), and one end of the rotation shaft of the motor is connected with one end of the lead screw.

* * * * *